United States Patent [19]

Hogregfe et al.

[11] Patent Number: 5,069,003

[45] Date of Patent: Dec. 3, 1991

[54] METHOD FOR MAKING MICROPRISMS

[75] Inventors: Robert Hogregfe, San Luis Obispo; David J. Knox, Los Osos; George E. Newman, Nipomo, all of Calif.

[73] Assignee: Dynatech Electro-Optics Corporation, San Luis Obispo, Calif.

[21] Appl. No.: 566,984

[22] Filed: Aug. 13, 1990

[51] Int. Cl.[5] ..... B24B 9/14

[52] U.S. Cl. ..... 51/283 R; 51/326; 359/642

[58] Field of Search ..... 51/283 R, 283 E, 284 R, 51/284 E, 326, 327, 277; 350/417, 286; 125/13.01

[56] References Cited

U.S. PATENT DOCUMENTS

| | | | |
|---|---|---|---|
| 2,409,108 | 10/1946 | Crowley | 51/283 R |
| 2,420,606 | 5/1947 | McLeod et al. | 51/283 R |
| 2,807,922 | 10/1957 | Newcomer et al. | 51/284 R |
| 3,254,556 | 6/1966 | Staunton | 51/283 R |
| 4,198,788 | 4/1980 | Fleetwood | 51/283 R |
| 4,623,225 | 11/1986 | Forkner | 350/286 |

*Primary Examiner*—Robert A. Rose

*Attorney, Agent, or Firm*—Daniel C. McKown

[57] ABSTRACT

A method for producing a number of microprisms from a plate of material includes the steps of blocking the plate onto a wedge and cutting a number of fiducial grooves in the wedge which are used in a subsequent step to determine the depth to which a polishing operation is continued. Using the method of the present invention, microprisms measuring approximately 375 microns in width and approximately 5 centimeters in length have been produced.

2 Claims, 2 Drawing Sheets

Fig. 1
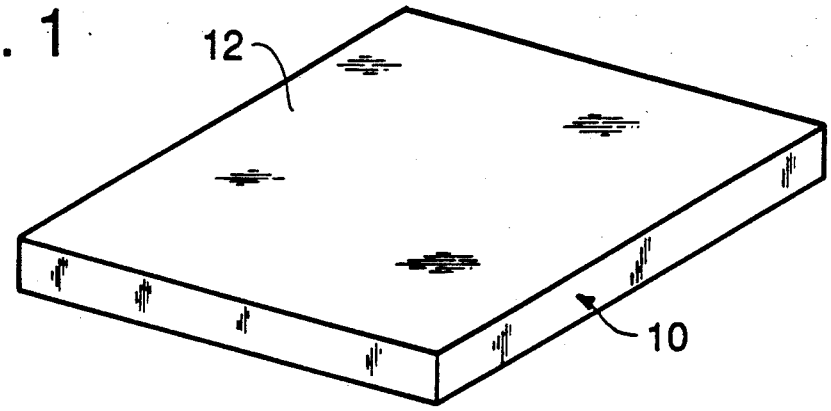
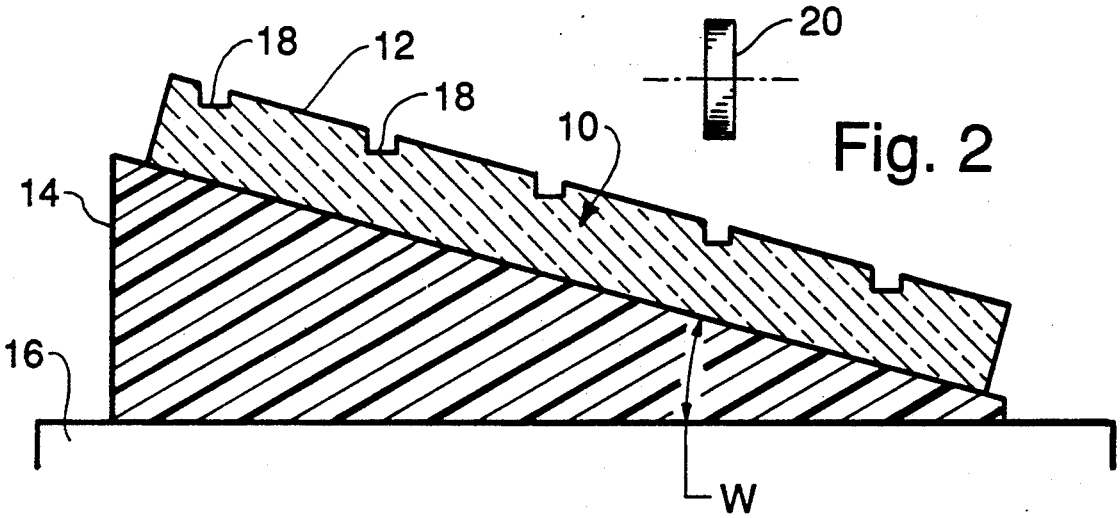
Fig. 2
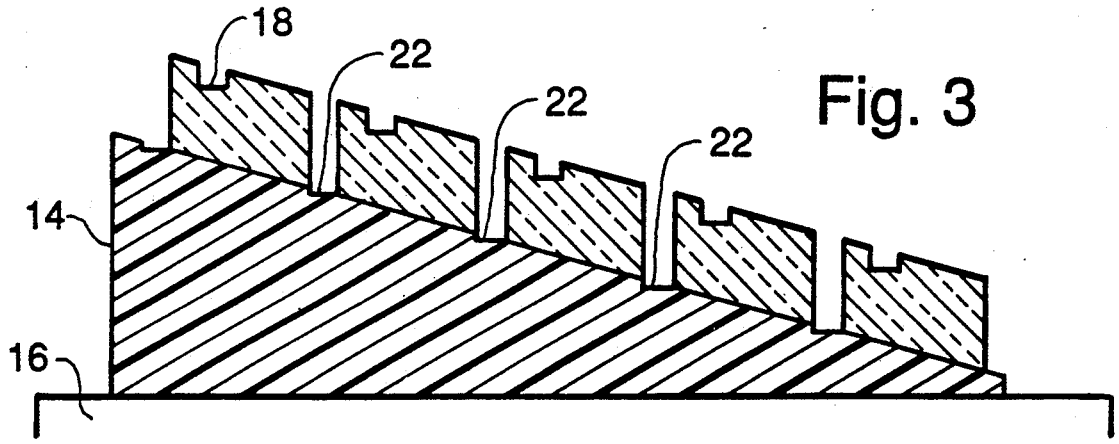
Fig. 3

METHOD FOR MAKING MICROPRISMS

BACKGROUND OF THE INVENTION

1. Field of the Invention

The invention is in the field of micromachining, and specifically relates to a method for producing optical quality prisms having faces on the order of 375 microns wide and several centimeters in length. The method is suitable even for relatively soft, but polishable materials, but is not appropriate for extremely hard materials. It has been extremely difficult, using traditional methods, to produce prisms of this size and aspect ratio, due partly to the brittleness of the material.

1. The Prior Art

Some of the operations of the method of the present invention are well-known in the fabrication of optical components, such as the operation of blocking a workpiece onto a substrate for the purpose of performing cutting or polishing operations on the workpiece. In a typical blocking operation, the substrate or block is prepared so as to have the desired shape to receive the workpiece, and thereafter, the workpiece is adhered to the block by a film of an adhesive material, which may be a pitch, a wax, or an epoxy, among other possibilities. The block supports and lends strength to the workpiece during the cutting or polishing operation. After the operation is concluded, the workpiece is separated from the block by the application of heat or a suitable solvent.

At two stages in the method of the present invention, the workpiece is blocked to a suitable substrate, but the blocking operation is not the crux of the present invention.

Likewise, the operations of cutting a material with a dicing saw and of polishing a material are very well-known in the fields of semiconductors and optics.

The present invention combines these operations in a novel way to permit a hitherto unattainable result to be achieved.

SUMMARY OF THE INVENTION

In accordance with the method of the present invention, a large number of microprisms are fabricated from a single plate of material measuring approximately 5 centimeters square and 1,000 microns thick. The plate is polished to the desired surface finish on one side. Thereafter, the plate is blocked onto a wedge inclined to the horizontal by an angle W, and with the polished face up.

Thereafter, a number of fiducial grooves are cut into the polished face of the plate. The grooves include vertical walls and the grooves extend parallel to the edge of the wedge. These grooves are an important part of the present invention and their use will be seen presently.

After the fiducial grooves have been produced, the workpiece is sawed in a direction parallel to the grooves but a constant distance from each groove, so as to produce a number of strips each having a parallelogrammatic cross section. The strips are then removed from the wedge-shaped block by use of a suitable solvent.

Next, a blocking plate is produced that has a surface which resembles a flight of stairs; that is, the blocking plate includes a number of spaced juxaposed planar surfaces that are inclined at an angle B with respect to the horizontal. The strips of the workpiece resulting from the previous sawing operation are then blocked onto the blocking plate with the polished faces of the strips lying against the planar surfaces that are inclined at an angle B.

Once the strips have been blocked onto the blocking plate, the next operation is carried out. It consists of polishing the strips and portions of the blocking plate by rubbing them in a horizontal direction with a suitably prepared polishing block.

At this point, the fiducial grooves formed in an earlier operation become quite important, because they permit the extent of the polishing operation to be discerned, so that it may be controlled. As the polishing progresses, the exposed width of the fiducial groove changes, increasing at first, and then decreasing until a predetermined width has been achieved.

At this point, the polishing operation is discontinued, and the microprisms are removed from the blocking plate by use of a suitable solvent. The mircoprisms have now been polished on both of their wider faces.

The microprisms thus produced have an extraordinary ratio of length to width, and may be sawed into shorter lengths if desired. Clearly the method lends itself to high volume production.

The method of the present invention assures that the edge of the prism defined by the two polished surfaces will be a blunt edge and therefore less susceptable to damage and chipping.

As will be seen below, the method allows a very wide choice of prism angles and face widths.

Because the method uses a highly controllable grinding operation, all of the dimensions can be maintained with extremely close tolerances.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view showing a plate that is the workpiece to which the method of the present invention is applied;

FIG. 2 is a side elevational view showing the workpiece on a first fixture after a first major step of the method has been performed;

FIG. 3 is a side elevational view showing the workpiece on the first fixture after a second major step of the method has been performed;

DETAILED DESCRIPTION OF THE PREFERRED EMBODIMENT

Figure 4:
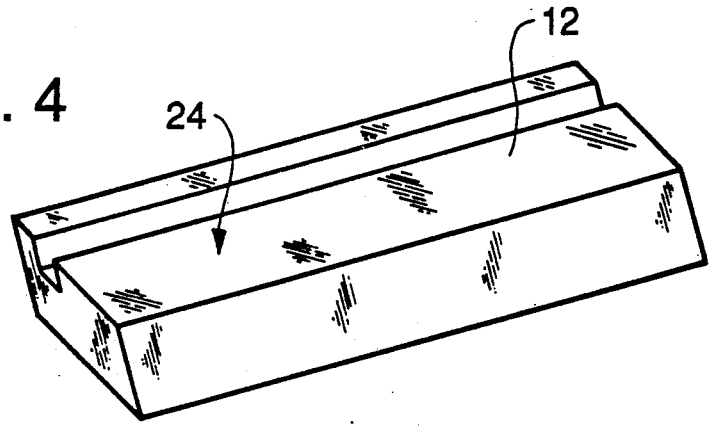
FIG. 4 is a perspective view showing an intermediate product produced by the first and second major steps of the method.

As shown in FIG. 1, the workpiece initially is in the form of a plate 10 that measures approximately 5 centimeters square and approximately 1,000 microns thick.

One surface 12 of the plate is polished to a desired finish. The plate may be of any material which can be sawed and polished. For example, microprisms have been made of zinc sulphide, of germanium, of glass, and even of sapphire.

As shown in FIG. 2, the plate 10 is affixed to a wedge 14, which is affixed to a horizontal table or base 16 with the polished surface 12 facing up.

Thereafter, a number of grooves 18 are cut into the plate 10 by a dicing saw 20.

Next, as shown in FIG. 3, a number of cuts 22 are made with the dicing saw to separate the plate 10 into a number of strips, the ends of which are seen in FIG. 3.

FIG. 4 is a perspective view showing an individual strip 24 of the type produced.

Figure 5:
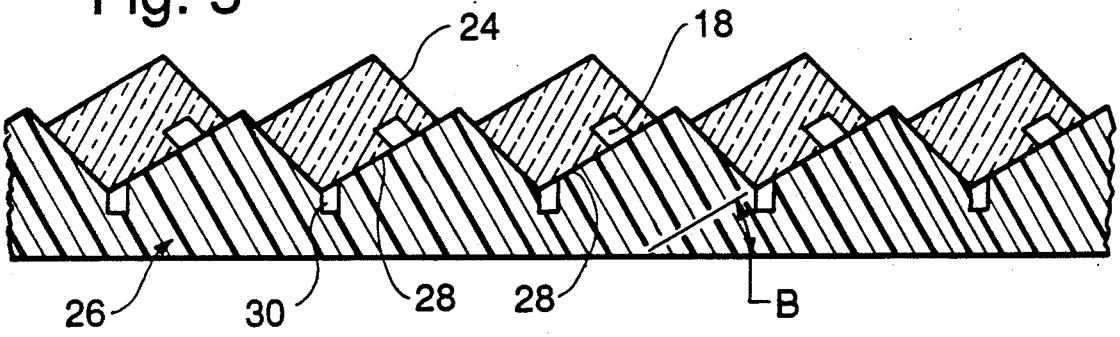
FIG. 5 is a side elevational view showing several of the intermediate products of FIG. 4 on a second fixture.

Next, as shown in FIG. 5, the individual strips 24 are mounted on a blocking plate 26 that includes a number of spaced juxtaposed planar surfaces 28 that are inclined at an angle B to the horizontal. In the preferred embodiment the blocking plate 26 is composed of the same material as the strips 24. A groove 30 in the blocking plate 26 provides a positive corner relief, thereby permitting the strips to seat properly.

Figure 6:
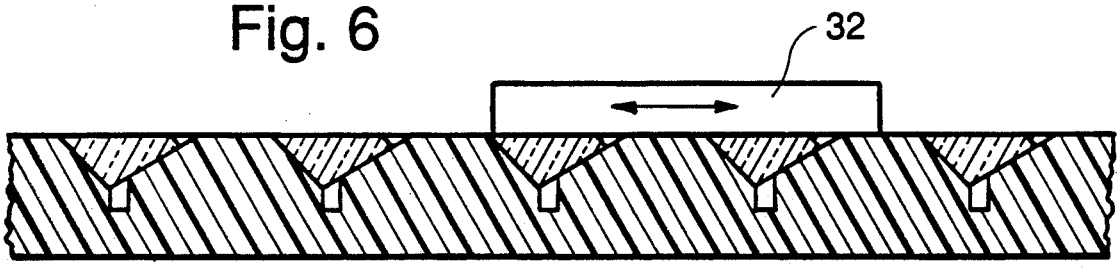
FIG. 6 is a side elevational view showing the intermediate products and fixture of FIG. 5 after another major step of the method has been performed.

Once the strips 24 have been mounted on the blocking plate 26 with the polished surface 12 facing down, they are ground, as shown in FIG. 6, to a predetermined depth by a horizontal polisher 32. The predetermined depth is indicated by the dashed line in FIG. 5, and the polisher 32 moves in a horizontal plane. The polishing operation proceeds until part of the strip 24 of the original workpiece and part of the blocking plate 26 are polished down to the level shown in FIG. 6.

As the polishing progresses, the apparent width of the groove 18 at first increases, and then starts to decrease. When the apparent width of the exposed groove 18 reaches a predetermined level, the polishing operation is discontinued, leaving the strips in the condition shown in FIG. 6. Thereafter, the strips are freed from the blocking plate 26 by soaking it in a suitable deblocking solvent.

Figure 7:
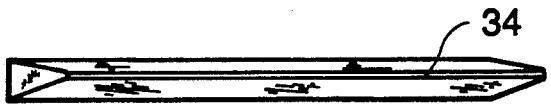
FIG. 7 is a perspective view showing the end product produced by the method.

The finished product of the method of the present invention is shown in FIG. 7. It is a microprism that may be as much as 5 centimeters in length and that may be as small as several hundred microns in width.

It should be noted that the remainder of the groove 18 ultimately becomes the blunted edge 34 of the microprism shown in FIG. 7. This intentionally-produced blunt edge is stronger than a sharp edge would be, and therefore better able to resist chipping.

Thus, there has been described and shown a method for the production for microprisms in which a fiducial groove is used to advantage.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A method for producing microprisms of triangular cross section having a first angle equal to 90° + W and a second angle equal to B from a plate of material that has been polished on a first face, said method comprising the steps of:

a) blocking the plate onto a wedge of angle W with the polished face up;

b) cutting fiducial grooves into the polished face of the plate parallel to the edge of the wedge;

c) sawing vertically through the plate a constant distance from each fiducial groove to produce a number of strips of parallelogrammatic cross section;

d) blocking the strips on a blocking plate that includes a number of spaced juxtaposed planar surfaces inclined at an angle B, with the polished faces against the planar surfaces; and, e) polishing the strips from above in a horizontal plane until the exposed width of the fiducial groove has decreased to a predetermined width.

2. The method of claim 1 wherein the fiducial grooves are equally spaced.

* * * * *